United States Patent [19]

Hoetzl et al.

[11] Patent Number: 4,834,344

[45] Date of Patent: May 30, 1989

[54] APPARATUS FOR INSIDE-OUTSIDE TUBE QUENCHING

[75] Inventors: Max Hoetzl; Robert M. Stahl, both of Toledo, Ohio; Louis E. Franceschina, Sault Ste. Marie, Canada

[73] Assignee: Surface Combustion, Inc., Maumee, Ohio

[21] Appl. No.: 17,214

[22] Filed: Feb. 20, 1987

[51] Int. Cl.[4] ..... C21D 9/08

[52] U.S. Cl. ..... 266/90; 266/117; 266/259

[58] Field of Search ..... 266/113, 114, 117, 134, 266/259; 148/153, 155

[56] References Cited

U.S. PATENT DOCUMENTS

| | | | |
|---|---|---|---|
| 2,882,191 | 4/1959 | Van Swaal | 266/134 |
| 3,671,028 | 6/1972 | Hemsath | 266/114 |
| 3,804,390 | 4/1974 | Jennings et al. | 148/153 |
| 3,997,375 | 12/1976 | Franceschina et al. | 148/143 |
| 4,032,369 | 6/1977 | Jatczak et al. | 148/143 |
| 4,116,716 | 9/1978 | Itoh et al. | 134/134 |
| 4,417,928 | 11/1983 | Heine, Jr. et al. | 148/144 |
| 4,458,885 | 7/1984 | Aiuta et al. | 266/117 |
| 4,490,187 | 12/1984 | Kruppert | 148/153 |

FOREIGN PATENT DOCUMENTS

| | | | |
|---|---|---|---|
| 86988 | 8/1983 | European Pat. Off. | 266/114 |

*Primary Examiner*—Christopher W. Brody
*Attorney, Agent, or Firm*—Body, Vickers & Daniels

[57] ABSTRACT

An inside-outside quench arrangement is disclosed for long steel pipe which utilizes a tangential quench arrangement to cool the pipe's outside surface and an axial flow nozzle to cool the pipe's inside surface at approximately the same cooling rate. The O.D. quench arrangement includes a manifold carrying jet nozzles circumscribing the pipe which can be pivoted apart to permit a four-bar linkage mechanism to smoothly and efficiently transfer the pipe into and out of the arrangement for quenching. A roller drive arrangement rotates the pipe in a longitudinally stationary position to minimize pipe bow and enhance pipe cooling.

5 Claims, 6 Drawing Sheets

AS QUENCHED HARDNESS VERSUS DISTANCE FROM OUTSIDE DIAMETER FOR AN I.D./O.D. QUENCH UNIT AND AN O.D. ONLY QUENCH UNIT

PIPE SIZE: 8.625" O.D. X 1.000" WALL
QUENCH TEMPERATURE: 1650 DEG. FAHRENHEIT

| COMPOSITION: | C | Mn | P | S | Si | Ni | Cr | MO |
|---|---|---|---|---|---|---|---|---|
| | 0.29 | 1.44 | 0.13 | .008 | 0.17 | 0.01 | 0.05 | 0.03 |

GRAPH OF PIPE TEMPERATURES FOR QUENCHING O.D. AND I.D.
PIPE SIZE = 9.625" O.D. X 0.435" WALL
PIPE ENTERS QUENCH 12 SEC. AFTER LEAVING FURNACE
DEAD ANGLE OF QUENCH = 60 DEG.

PIPE BOW VERSUS REVOLUTIONS FOR PIPES OF 4.500" DIA X .250" WALL 9.625" DIA X .435" WALL AND 14.500" DIA X .500" WALL

APPARATUS FOR INSIDE-OUTSIDE TUBE QUENCHING

BACKGROUND OF THE INVENTION

This invention relates to method and apparatus for quenching ferrous and non-ferrous tubular members and, more particularly, to an apparatus and method for the high speed quenching of tubular members at approximately uniform cooling rates on the inside and outside surfaces while minimizing deformation thereof.

The invention is particularly applicable to quenching, in a steel mill environment, heavy-walled steel pipe to produce a relatively uniform martensitic structure throughout and will be described with particular reference thereto. However, it will be appreciated by those skilled in the art that the invention has broader application and may be used to cool any heated cylindrical member in a relatively uniform manner.

Heat treating long lengths of steel pipe or tubular members had long presented a problem for the steel mill industry and a number of different approaches have been used to address this problem with varying degrees of success. In the conventional heat treat process, the tubular member is heated to a temperature above the austenitic temperature to achieve the necessary phase transformation throughout the tubular member and the tubular member is then cooled at a rate at least equal to the critical cooling curve to produce a martensitic structure which is sufficient to result in the desired hardness. The inherent problem for many pipe applications requiring through hardening is to quench the tubular member in such a fashion that a relatively uniform martensitic grain structure is produced throughout the wall cross-section of the tubular member. If the inside and outside surfaces of the tubular member are not cooled at a sufficient rate, then the martensitic structure will only occur on the inside and outside external surfaces and possibly not in the interior of the wall section. As is conventionally known, the volume expansion resulting from the non-uniform martensite transformation will tend to produce cracks at the exterior surfaces and dimensionally distort the tubular member, the distortion occurring either in the roundness, the straightness, and/or surface markings on the tubular member. The problem as thus explained is particularly compounded for heavy walled pipe where through quenching is difficult to achieve and, in many applications, require the addition of expensive alloys, to shift the knee of the continuous cooling transformation curve so that the desired martensitic structure can be produced.

Various quench arrangements have been heretofore used which have as their objectives, fast quenching rates with minimal distortion tendencies. U.S. Pat. No. 3,671,028 to Klaus Hemsath and assigned to the present assignee discloses an outside quench system which utilizes a plurality of jet nozzles positioned in an annular array to effect a highly efficient heat transfer cooling rate (using "fresh" as contrasted to "spent" quench liquid) on the outside surface of the pipe in a pass-through quench system. Certain aspects of the '028 patent are utilized in this invention and the '028 patent is hereby incorporated by reference. However, the system disclosed in the '028 patent is directed only to quenching the outside surface of the pipe and is not applicable to those applications where the pipe has significant wall thickness. Also, the quench mechanism of the '028 patent is a "pass-through" type, which progressively cools only portions of the tubular member as the tubular member is longitudinally moved or passed through the quench. Thus, there are inherent problems resulting from the adverse effects of cooling, by conduction, the still hot portion of the pipe outside the quench vis-a-vis that portion of the pipe which is inside the quench which limit the suitability of the quench arrangement to certain applications.

Several arrangements for simultaneously quenching the inside and outside surfaces of a tubular member have been utilized with some success. U.S. Pat. Nos. 4,116,716 to Itoh et al and 3,997,375 to Franceschina et al typify such approaches. In these arrangements, the tubular member is immersed in a cooling tank and a nozzle is inserted into the tubular member at one end thereof. The bath cools the ouside surface of the tubular member while the water from the nozzle cools the inside surface. When the tubular member, however, is immersed in the tank, a steam vapor barrier is immediately produced at the surface of the tubular member which inhibits a fast cooling rate. The cooling along the inside surface of the tubular member by means of a nozzle would be faster than that at the outsi e pipe surface limiting the applications of the quench and tending to deform the tubular member for reasons noted above.

Recognizing the limitations of the cooling tank quench, a number of "pass-through" quench arrangements have been used which employ a lance-mandrel arrangement for the interior spray nozzle to cool the inside of the pipe and various radially directed nozzle or radial flow arrangements for cooling the outside surface of the tubular member. U.S. Pat. Nos. 4,417,928 to Heine et al, and 4,490,187 to Krupport illustrate various arrangements using this approach. However, all of such arrangements described must employ complicated support structures for suspending the lance within the interior of the pipe as it longitudinally travels along the lance's axis. In addition, since all such arrangements use a pass-through technique, there is a progressive cooling of the pipe with the attendant deformation problems resulting therefrom as noted above. The problem is further aggravated because the quench liquid from the interior nozzle passes through the tubular member before the entire outside surface of the pipe is cooled by the quench mechanism. Furthermore, the radially-inwardly directed nozzles used to cool the outside surface of the tubular member are spaced from one another a considerable distance (in a relative sense). This spacing creates a steam barrier or stagnation region between longitudinally adjacent nozzles which inhibits cooling and promotes metallurgical non-uniformity properties in the pipe (and thus deformation) even though any particular stagnation zone is, within a short time, removed as the pipe's movement places the zone under the full force of the jet. To reduce the size of the stagnation zones to workable limits, the pressure of the nozzles must be increased, typically to about 100 psi to create sufficient turbulence at the pipe surface to reduce the stagnation zone areas. This in turn, increases the sizing of the pumps and other system components and the energy requirements of such systems than that which otherwise may be required.

This feature is accomplished in a quench arrangement rotating the tubular member about its longitudinal axis while maintaining the member in a longitudinal stationary position; directing along generally tangential axes relative to the O.D. of the member a plurality of liquid cooling jet streams circumscribing the tubular member, the streams also being located at spaced intervals along the longitudinal axis and removed from the outside surface of the member so that the entire outside surface of the member along its longitudinal axis is engulfed engulfed and cooled by the cooling liquid emanating from the tangential jet streams; and, directing into the member along its longitudinal axis and from one end thereof a solid liquid cooling jet stream whereby the entire inside surface of the member is in complete contact with and cooled by the cooling liquid emanating from the longitudinal jet stream. Because the tubular member is rotated about its longitudinal axis while the member is in a longitudinally stationary position, the quench arrangement of the present invention subjects the tubular member to cooling along its entire length, thus removing the objectionable features of the pass-through quench system discussed above. The rotation of the tubular members which minimizes pipe bow is a achieved by drive roller units. A plurality of O.D. quench supply means spaced at intervals along the tubular member's longitudinal axis and encircling the member is then provided for cooling the outside surface of the tubular member. Each O.D. quench supply means includes a plurality of jet spray nozzles spaced longitudinally and circumferentially about the tubular member at a distance removed from the outside surface of the member with the axis of each jet spray nozzle oriented in a generally tangential direction to the O.D. of the tubular member so as to produce a jet stream of cooling liquid to efficiently cool the outside surface of the pipe at a fast rate with minimal pressure. An I.D. quench supply means including a jet spray nozzle positioned at one end of the tubular member having an axis generally in line with the horizontal axis of the tubular member is provided for cooling the inside surface of the tubular member at approximately the same cooling rate as the O.D. quench supply means.

In accordance with another aspect of the invention, high heat transfer coefficients can be achieved at the outside surface of the tubular member. The tangential jet streams are directed to oppose the direction of rotation of the tubular member to increase the velocity of the cooling liquid relative the surface of the tubular member. In this manner, a swirling mass of "fresh" liquid coolant is placed in excellent heat transfer relationship with the outside surface of the tubular member.

In accordance with yet an other aspect of the invention, bending of the tubular member is minimized by controlling the rotational speed of the member such that tubular members having large diameters are rotated at slower speeds than tubular members having smaller diameters. Additionally, the rotation of the tubular member prevents circumferential temperature gradients from occurring about the inside surface of the pipe when quenching by means of the I.D. quench nozzle. Such temperature gradients could adversely effect the metallurgical properties at the inside surface and deform the tubular member.

In accordance with yet another important aspect of the invention, the quench mechanism is constructed to provide a simple and highly efficient method for processing steel pipe in a steel mill. The pipe is simply conveyed from the reheat furnace to a waiting position whereat it is laterally moved into the quench mechanism in a quench position, and after the tubular member is quenched, it is laterally moved to a removal position whereat it is conveyed away from the quench mechanism. This is achieved through the design of the O.D. quench supply means which include first and second quench supply manifolds for carrying cooling liquid therein, with each manifold having a top and bottom closed end and pivot means for bringing the closed ends of each manifold into close proximity with one another in a quench position so that both manifolds together, circumscribe the tubular member and then actuating the pivot means to move the top ends of the quench supply manifolds away from one another when the quench is in the transfer position to permit the tubular member to be lifted from the quench and moved to the removal station. The quench supply manifolds in turn carry the spray headers which in turn carry the tangentially directed spray nozzles for directing the jet streams in a swirling mass about the outside surface of the tubular member. This heat transfer relationship is achieved along the outside surface of the tubular member over the entire length of the tubular member by providing within each O.D. quench supply means a plurality of the tangential jet streams longitudinally spaced in close proximity to one another throughout the entire length of each O.D. quench supply means. This spacing precludes the formation of any significant stagnation zone between adjacent swirling masses of liquid coolant thus permitting even, uniform heat transfer (and thus metallurgical properties) without significant deformation over the entire length of the tubular member. It has been determined that high heat transfer coefficients can be achieved in the present invention with low nozzle pressures, typically in the order of 20 psi, thus resulting in a reduction of the energy requirements for the present invention while reducing the capital costs for the system when compared to the high pressure requirements of prior art quench systems.

In accordance with still another aspect of the present invention, a wide variety of pipe sizes can be accommodated within the quench arrangement of the present invention by providing adjustable idler roller means associated with each O.D. quench supply means to maintain, notwithstanding the diameter of the pipe, the horizontal axis of the tubular member in a centered position within the circular array of tangentially directed nozzles. The tangentially directed nozzles are also adjustable by rotation of the supply headers about their longitudinal axes so as to maintain a tangential arrangement between the jet spray axes and the O.D. of the tubular member.

In accordance with yet another aspect of the present invention, a simple four-bar link mechanism gently lifts, laterally moves, and gently sets down the tubular members with little rotation about its vertical axis to minimize any upset to the tubular member. The four-bar mechanism permits one tubular member to be transferred from the furnace discharge conveyor to the quench station while simultaneously transferring another tubular member from the quench station to the removal station to achieve fast and efficient processing of pipe through the mill. By counterbalancing the driving links of the four-bar link the power requirements for this transfer device are minimized. The design of the four-bar linkage provides for continuous rotation as opposed to a reversing motion of the four-bar linkage to further enhance the speed of the pipe processing time in the mill.

In accordance with still another feature of the present invention, and while it is contemplated that both the I.D. and O.D. quench supply means would operate to produce the same cooling rates at both the inside and outside surfaces, the quench arrangement could, depending on the service application requirements for the tubular member, be operated with I.D. quench supply means inoperative so that only the outside surface of the tubular member is quenched or the O.D. quench supply means could be inoperative so that only the inside surface of the tubular member is quenched or the flow rates between the I.D. and O.D. quench supply means controlled at some ratio to impart desired metallurgical properties to the tubular member. In this way, a heavy duty quench arrangement could easily function in an efficient manner for a wide variety of pipe heat treatments.

It is thus the principal object of the present invention to provide a method and apparatus for cooling tubular members to produce uniform metallurgical properties in the member while minimizing the tendency of the member to bow.

It is another object of the invention to provide an apparatus and method for simultaneously cooling the inside and outside surfaces of the tubular member at high cooling rates by minimizing the adverse effects of coolant vapor.

It is another object of the present invention to provide a quench system which permits, by virtue of its inherent capability to achieve high cooling rates, satisfactory quenching of pipe having heavier walls for any given steel composition when what was otherwise heretofore possible or, alternatively, to use lesser amounts of alloy additions to steels for quenching a given pipe wall thickness than what was otherwise heretofore possible.

Yet another object of the present invention is to provide an efficient and fast quench arrangement which permits the tubular members to be quenched in a longitudinally stationary position made possible by utilizing the "clam shell" configuration of the O.D. quenching means in combination with a walking arm mechanism for charging and discharging the tubular members.

It is yet another object of the present invention to eliminate the potential for prequenching a tubular member due to water dripping from nozzles in prior art devices which direct radial coolant streams against the outside surface of the tubular member.

Yet a still further object of the present invention is to provide a quench system which varies the rotation of the tubular member about its longitudinal axis to minimize bowing while simultaneously minimizing the formation of cooling vapor about its inside surface to enhance the cooling rate of the tubular member's inside surface.

It is a still further object of the present invention to provide a quench arrangement which, by virtue of its configuration, can satisfactorily quench a large number of different length pipes and which is easily adjustable to quench a wide variety of pipe diameters.

It is yet another object of the present invention to provide a quench arrangement which is relatively inexpensive to construct and operate.

it is a still further object of the present invention to provide a quench arrangement which can be selectively operated to cool either the outside surface or the inside surface of long tubular members independently or dependently of one another.

Still further advantages of the invention will become apparent to those of ordinary skill in the art upon a reading and understanding of the following description of the preferred embodiment.

BRIEF DESCRIPTION OF THE DRAWINGS

The invention may take form in certain parts and arrangement of parts, a preferred embodiment of which will be described in detail herein and illustrated in the accompanying drawings which form a part hereof and wherein:

Referring now to the drawings wherein the showings are for the purpose of illustrating a preferred embodiment of the invention only and not for the purpose of limiting same, the invention may best be explained by first illustrating in schematic form the workings of the quench arrangement to cool a tubular member 10 before explaining in detail the mechanism utilized to effect such quenching. FIGS. 1 and 2 schematically illustrate the quench arrangement used to cool the outside surface 12 of tubular member 10. For purposes of reference, tubular member 10 has a longitudinal axis 14, a laterally extending or horizontal axis 15 and a vertically extending or vertical axis 16. A plurality of water spray headers 18 are spaced at equal increments a radial distance removed from the outside surface 12 of tubular member 10 and are also spaced at equal increments between one another. More specifically, the longitudinal center line 19 of each spray header falls on the circumference of an imaginary circle 20 which has a diameter larger than the diameter of tubular member 10 and the spacing between adjacent spray headers 18 is equidistant about imaginary circle 20. From a strictly functional viewpoint, each spray header 18 extends longitudinally a distance equivalent to the length of the tubular member 10 which is to be quenched. Each spray header 18 has a plurality of jet nozzles 2 extending therefrom at equally spaced intervals along the length of each header as best shown in FIG. 2. Nozzles 22 eject a jet spray of liquid coolant preferably water, against the outside surface 12 of tubular member 10. A mechanism to be described hereafter permits each spray header 18 (and its corresponding nozzles 22) to be rotated about each header's longitudinal axis 19 and all spray headers to be equally rotated in unison. This permits the O.D. coolant flow indicated by arrows 24 in FIGS. 1 and 2 to be adjustable along different inwardly directed axes 26 i.e., the center of jet nozzle 22. As best seen in FIG. 1, each nozzle's inwardly directed axis 26 for each spray header 18 would be tangential to an imaginary water spray circle 28 and if the tubular member 10 were not present in the quench arrangement, the force and velocity of the water flows emanating from nozzles 22 would be sufficient to form a swirling mass of coolant in an annular configuration, centered about the circumference of imaginary water spray circle 28. The water will swirl preferably in a direction opposite to the direction of rotation as shown by arrow 30 of tubular member 10. Preferably, the inward directed axis 26 of each nozzle 22 will be oriented always to form an imaginary water spray circle 28 having a diameter less than the outside diameter of tubular member 10, however, it is contemplated that the inwardly directed axis 26 of each nozzle 22 may be oriented anywhere from a plane which intersects longitudial center line 14 of tubular member 10 to a plane which is tangential to the outside surface 12 of tubular member 10 as shown by the angle designated as "A" in FIG. 1. Reference may be had to U.S. Pat. No. 3,671,028 for a further explanation of the arrangement shown in FIGS. 1 and 2 for quenching the outside surface 12 of tubular member 10.

Figure 2:
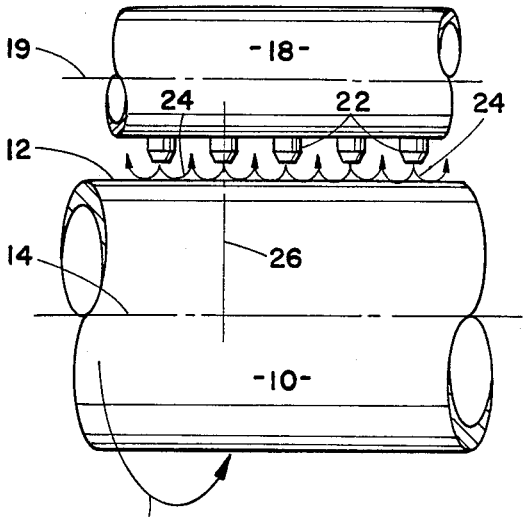
FIG. 2 is a schematic plan view illustrating coolant flow on the outside surface of the tubular member.

The arrangement disclosed is extremely effective in penetrating and removing the water steam vapor barrier which tends to form in prior art quench mechanisms. Rotating tubular member 10 in a direction opposite to the swirling annular water mass formed by the jet sprays further reduces the steam vapor barrier and the high quenching rate is maintained uniformly over the entire length of the pipe because, as shown in FIG. 2, the inward directed axis 26 of each nozzle 22 is perpendicular to the longitudinal axis 14 of tubular member 10. Thus, any tendency of the coolant to spread longitudinally along the tubular member 10 is resisted by the flow of the coolant mass from an adjacent nozzle 22 with the result that the entire force of the coolant is directed against the outside surface 12 of tubular member 10 to reduce and minimize the adverse effects of the steam vapor barrier and to prevent the formation of any stagnation regions characteristic of prior art quenches. Based on typical operating conditions, lab and field tests have verified that a heat transfer coefficient of approximately 3,000 btu's/hr/ft$^{2}$° F. has been achieved utilizing the quench arrangement disclosed herein. In most cases, the heat removal rate at the outside surface 12 of tubular member 10 is four (4) times greater than the heat transfer rate through the material. Therefore, the heat transfer condition is conductivity limited. Also, as described, because the present invention does not result in any stagnation region between jets which tends to promote the vapor layer, the quench of the present invention can operate at lower water pressure, typically in the order of 20 psi, than that of prior art radial quench arrangements which required pressure as high as 100 psi to minimize the effects of the stagnation regions.

Figure 3:
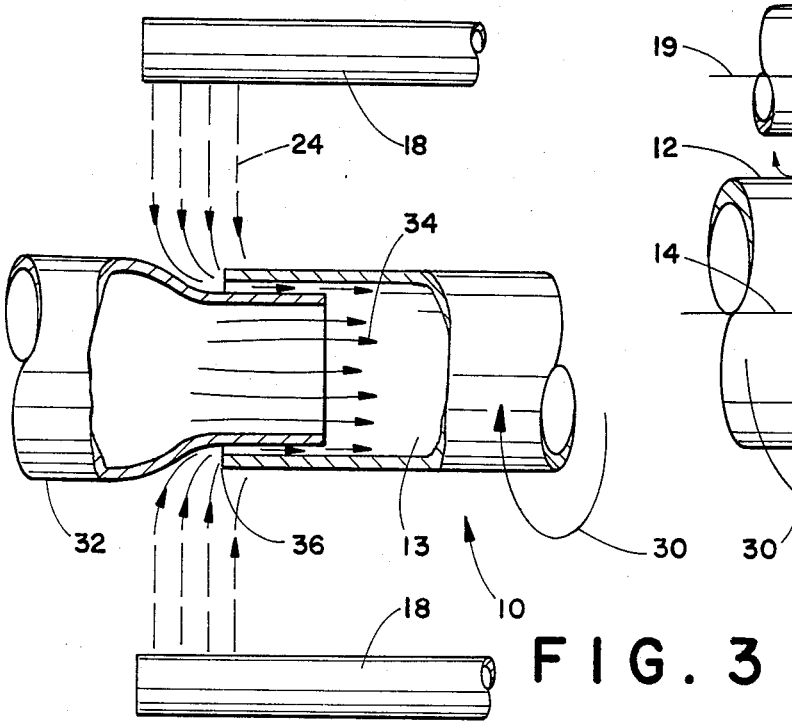
FIG. 3 is a schematic elevation view of the cooling arrangement used in the present invention to cool the inside surface of the tubular member.

FIG. 3 schematically illustrates the quench arrangement used to cool the inside surface 13 of tubular member 10. This is achieved by an axial flow nozzle 32 positioned within tubular member 10 at one end thereof. Axial flow nozzle 32 discharges a high volume rate of coolant indicated by arrows 34 which flow from one end 36 of tubular member 10 longitudinally to and through the opposite end. To insure quenching of tubular end 36, the spray headers 18 extend slightly beyond tubular end 36 to insure O.D. coolant flow 24 between the inside surface 13 of tubular member 10 and the axial flow nozzle 32. The solid water jet 34 has been found to be very efficient at removing the vapor layer at the inside pipe surface 13 and heat transfer coefficients very similar to that obtained by the "tangential" or O.D. quench illustrated in FIGS. 1 and 2 of approximately 3,000 bts/hr/ft$^{2}$° F., have been achieved. Similarly, the heat removal rate at the inside surface has been found to be approximately four (2) times greater than the heat transfer rate through the cross-section of the tubular member and the heat transfer condition thus described is conductivity limited. It is to be noted that the pipe rotation is essential to achieving the uniform heat transfer rates described because a lack of rotation of tubular member 10 can cause circumferential temperature gradients to build up around the inside surface 13 and/or outside surface 12 of tubular member 10. Such temperature gradients will result in a non-uniform heat transfer condition about inside surface 13 and/or outside surface 12 and will result in bowing and non-uniform metallurgical properties. It is also to be noted that by simply positioning axial flow nozzle 32 at the end 36 of tubular 10 the quench design is considerably simplified when compared to the prior art arrangements utilizing lance-mandrel supports for the I.D. quench. Importantly, since the axial flow nozzle 32 does not contact the tubular member there is no possibility of binding or requirements for supporting a lance as in prior art quench arrangements.

Figure 1:
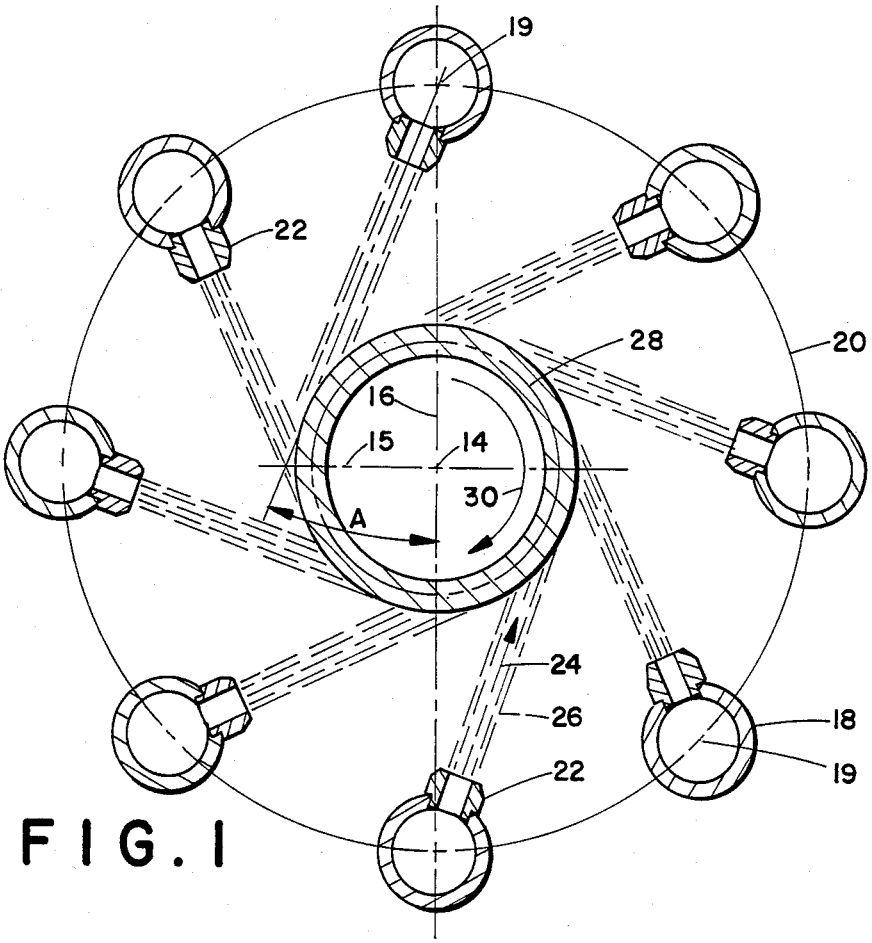
FIG. 1 is a schematic cross-sectional view showing the outside quench arrangement used in the present invention.

FIGS. 4 through 7 illustrate the mechanism of the present invention which permits the quench system described in FIGS. 1–3 to operate. The general flow of the work or tubular members 10 may best be understood by reference to FIGS. 4 and 6. Long tubular members, approximately 20 to 50 feet in length, are heated above their austenitic temperature, approximately 1650° F. in a reheat furnace the end of which is generally shown by line 40. Tubular member 10 exits the reheat furnace at 40 and travels longitudinally by means of a driven conveyor 42 until it comes to a stop at one end of the quench mechanism end being indicated by line 46 in FIG. 4. At this point, tubular member 10 is in a receiving position and will be moved laterally into the quench mechanism 45 where it will be in a quenching position and after being quenched, tubular member 10 will be moved laterally into a removal position shown as an inclined platform generally indicated in FIG. 4 as surface 48 defined by the dot-dash rectangle.

Figure 4:
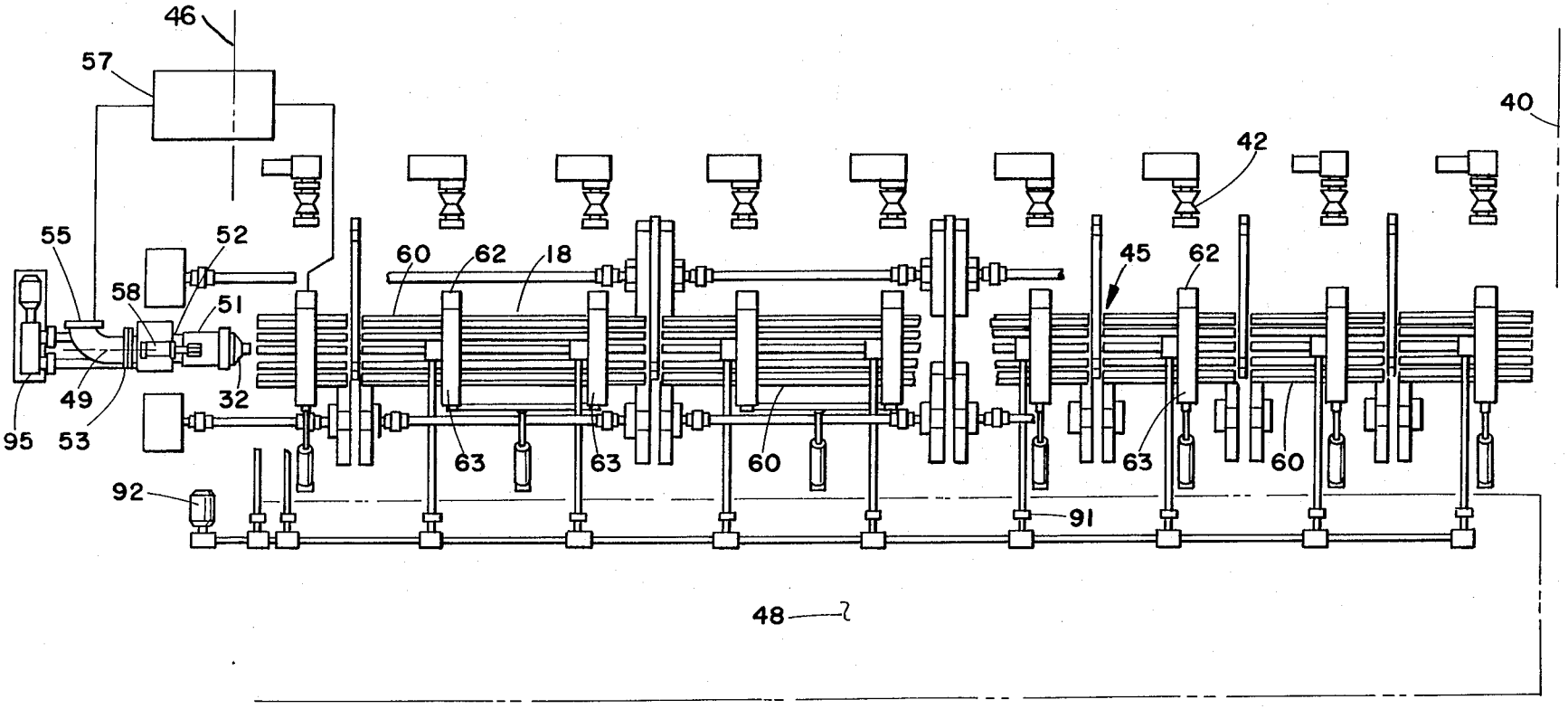
FIG. 4 is a plan view of the quench arrangement.
Figure 5:
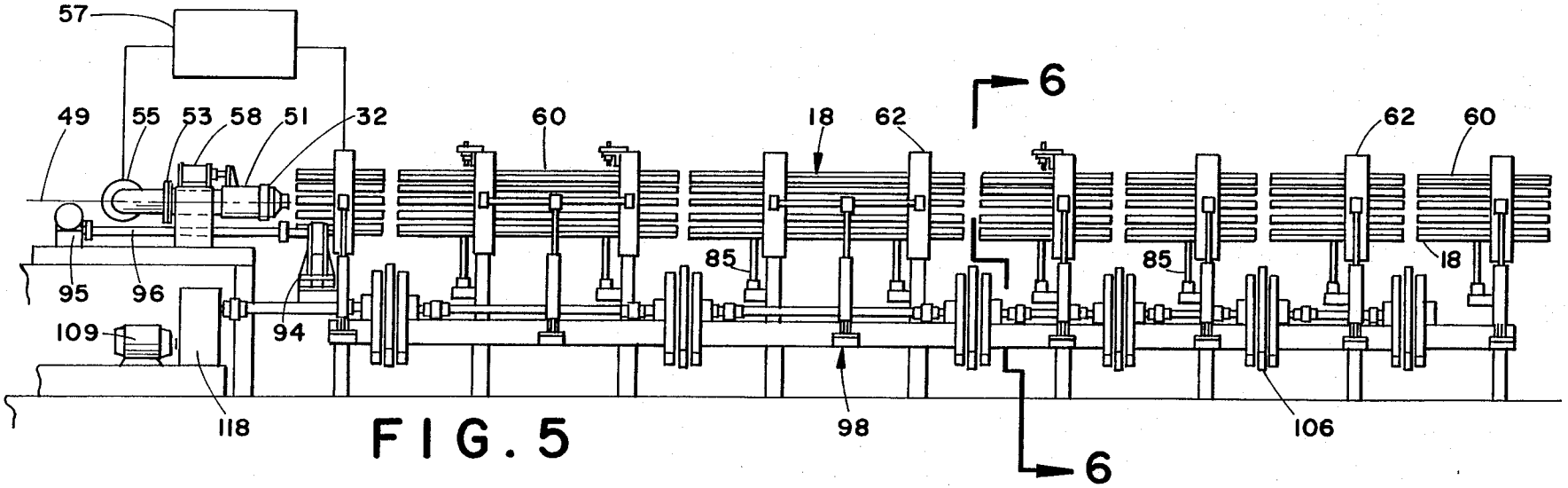
FIG. 5 is an elevation view of the quench arrangement.

Referring now to FIGS. 4 and 5, quench mechanism 45 includes axial flow I.D. nozzle 32 having a longitudinal center line coinciding with the longitudinal center line of quench mechanism 45 which, in turn, will coincide with longitudinal axis 14 of tubular member 10. I.D. nozzle 32 is mounted to a cylindrical sleeve 51 which in turn is in sealing, sliding engagement with and receives a smaller cylindrical sleeve 52 in turn secured by appropriate flange connection 53 to an axial flow water supply line 55. Conventional valving, not shown, is actuated by a controller 57, which may be microprocessor driven, to control the rate of flow of liquid coolant through axial flow nozzle 32. A pneumatic or hydraulic cylinder 58 controls the longitudinal position of I.D. nozzle 32 so that I.D. nozzle 32 is retracted from quench mechanism 45 when tubular member 10 is being transferred from or to quench mechanism 45.

Quench mechanism 45 includes a plurality of quench supply means 60, there being seven quench supply means 60 illustrated in FIGS. 4 and 5. Each quench supply means includes first and second quench supply manifolds 62, 63 respectively, each of which are connected by appropriate valving to a source of liquid coolant the flow of which is regulated by controller 57. Each first and second quench supply manifold 62 carries a plurality of spray headers 18 to quench the tubular member 10 in the manner aforesaid.

Figure 7:
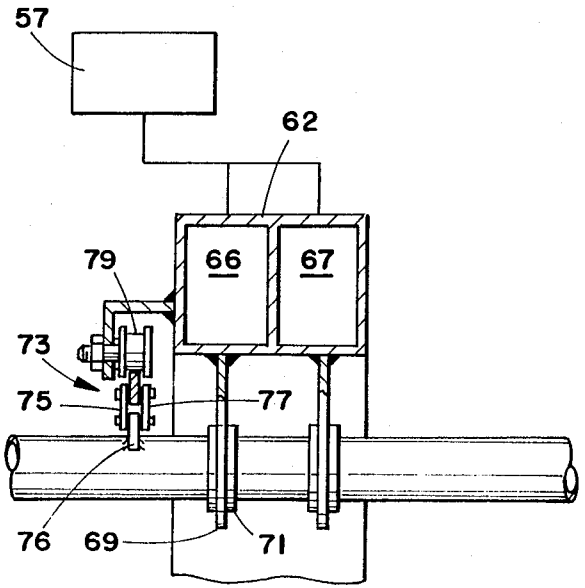
FIG. 7 is a sectional view of a portion of the quench arrangement taken along line 7—7 of FIG. 6.
Figure 6:
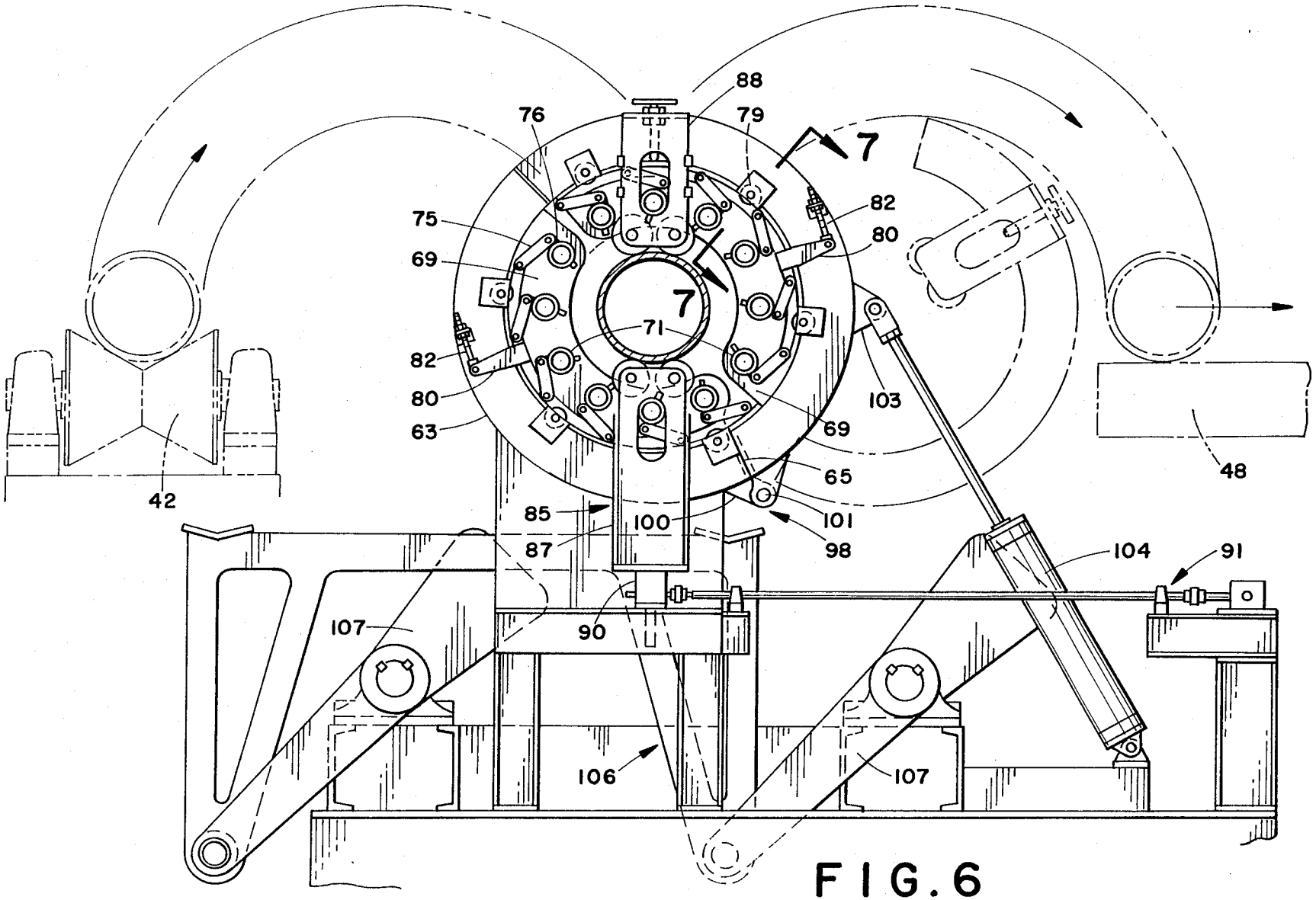
FIG. 6 is a sectional view of a portion of the quench arrangement taken along line 6—6 of FIG. 5.

Referring now to FIGS. 6 and 7, each quench supply manifold 62, 63 is a semi-circular or C-shaped fabrication having a general rectangular cross-section with closed ends 65 to define a generally annular chamber. In FIG. 7, the annular chamber is divided into two annular chambers 66, 67, one chamber 66 being adapted to be in fluid communication with half of the spray headers 18 associated with that particular manifold while the other annular chamber 67 is adapted to be in fluid communication with the other spray headers 18 associated with the particular manifold so that when small tubular members are being quenched, only one of the annular chambers 66 or 67 need be supplied with coolant liquid. Annular chambers 66, 67 are connected by conventional valving to controller 57 for regulating the flow and the pressure of the coolant in each of the chambers. (It is to be noted that in accordance with certain aspects of the invention, controller 57 can be programmed to shut off the supply of coolant fluid to either axial flow nozzle 32 or annular chambers 66, 67 or control the respective fluid flow therethrough in accordance with predetermined parameters.) Extending from the interior surface of each quench supply manifold 62 and 63, there are two ring shaped flanges 69 which have a plurality of openings 71 spaced at equal circumferential distances, there being six openings 71 shown for each quench supply manifold 62, 63. Bushings within each opening 71 permit each spray header 18 which is inserted into the opening 71 to be rotated. Adjusting linkage 73 permits spray headers 18 and their associated nozzles 22 to be rotated in unison and thereby direct the jet streams of cooling liquid either away from or towards the longitudinal axis 14 of tubular member 10. Adjusting linkage 73 includes a link 75 for each spray header 18. Each link is pinned at one end to a projection 76 extending from spray header 18 and at the other end to a rotatable ring 77 which in turn is supported by rollers 79 secured to the quench supply manifolds 62, 63 and spaced in equal circumferential intervals about the periphery of rotatable ring 77. An arm 80 attached to rotatable ring 77 for each quench supply manifold 62, 63 extends radially outward therefrom and has its free end connected to an adjustable push-pull rod 82 for rotating rotatable ring 77 a fraction of a revolution to uniformly tilt spray headers 18 and their jet nozzles 22.

Tubular member 10 is supported in quench mechanism 45 by an adjustable idler roll mechanism 85, there being an idler roll mechanism 85 for each pair of quench supply manifolds 62, 63. Idler roll mechanism 85 includes two bottom idler rollers 87 automatically adjustable by a bottom support screw jack actuator 90, each screw jack actuator 90 for each idler roll mechanism 85 being actuated for vertical adjustment of tubular member 10 by a driven shaft arrangement 91 which interconnects all the idler mechanism 85 for the entire quench and which is driven by an external motor 92 (FIG. 4). Drive shaft arrangement 91 also controls the height of the drive roller mechanism 94 which rotates tubular member 10 within quench mechanism 45. The drive roller mechanism is driven by its own motor 95 connected to drive rollers 94 to an appropriate universal drive shaft 96. Idler mechanism 85 also includes a pair of top idler rolls 88 mounted on the first or movable quench manifold 62 but adjustable by an appropriate actuator.

In order to permit tubular members 10 to be placed into and withdrawn from the quench, each quench supply means 60 is provided with a pivoting arrangement 98. Pivoting arrangement 98 includes fixing the second or fixed quench supply manifold 63 to a support structure such as by welding as shown in FIG. 6. At the bottom end 65 of each quench supply manifold 62, 63 a lug 100 is formed with an opening through which an appropriate pin is inserted. A second lug 103 is formed on the first or movable quench supply manifold 62. Attached to second lug 103 is a pneumatic cylinder 104 which when actuated pivots first on movable quench supply manifold 62 about its first lug 100 to open the quench supply means as shown by the dot-dash line in FIG. 6. The actuation of cylinders 104 are controlled so that all cylinders simultaneously open the quench supply means, or if shorter pipe were being processed through the unit, only those quench supply means 60 which encompass the tubular member 10 would be actuated. The quench mechanism as thus described can be envisioned as and has been referred to as the "clam shell" quench.

In order to permit the actual transfer of the tubular members 10 into and out of the quench mechanism 45, when the quench supply means 60 are open, a walking arm arrangement 106 is positioned directly beneath the slight spacing (approximately four inches) which exist between adjacent quench supply means 60. As best shown in FIG. 6, the walking arm arrangement 106 is a four-bar linkage appropriately sized to lift and move tubular member 10 in an arcuate path from the receival station 46 to the quench mechanism 45 while simultaneously lifting and moving a quench tubular member 10 in an arcuate path from the quench mechanism 45 to the removal station 48 and the driving arms 107 of the walking arm arrangement 106 are appropriately counterweighted to provide the desired lift motion with minimum power requirements. As best shown in FIGS. 4 and 5 both driving arms 107 are driven in unison by a motor 109 connected to a gear reducer set 118 which by means of appropriate drive shafts and couplings synchronously rotates each driving arm 107 for all the walking arm arrangements 106 throughout the quench.

The quench arrangement illustrated in FIGS. 4 and 5 is designed to quench tubular members of from 20 to 50 feet in length. As a minimum there must be at least two walking arm mechanisms 106 and thus three quench supply means 60 to quench any tubular member 10. Two of the quench supply means 60 as shown in the drawings are approximately twice the length shown for the other quench supply means 60 and to assure even coolant spray throughout the longer quench supply means 60, two pairs of quench supply manifolds 62, 63 are utilized. The reason for sizing the quench supply means in this fashion is that some of the tubular members produced in steel mills are in the neighborhood of 20 feet in length and would be treated in the first three quench supply means starting from the left hand side of the quench mechanism 45 as shown in FIGS. 4 and 5. Longer length tubular members would then result in the activation of additional quench supply means 60 as required thus resulting in savings associated with quench fluid utilization. It is not contemplated that the distance between the quench means, which is necessary to permit the walking arm arrangement 106 to function, will result in any significant stagnation region on the tubular member and that the steam vapor barrier between adjacent quench supply means will be reduced in the same manner that such steam vapor barrier is reduced within each quench supply means as illustrated and discussed with respect to FIG. 2. To facilitate this vapor barrier removal, nozzles 20 at the ends of spray headers 18 are directed at the area of the tubular member 10 which is between adjacent quench units 60.

Figure 8:
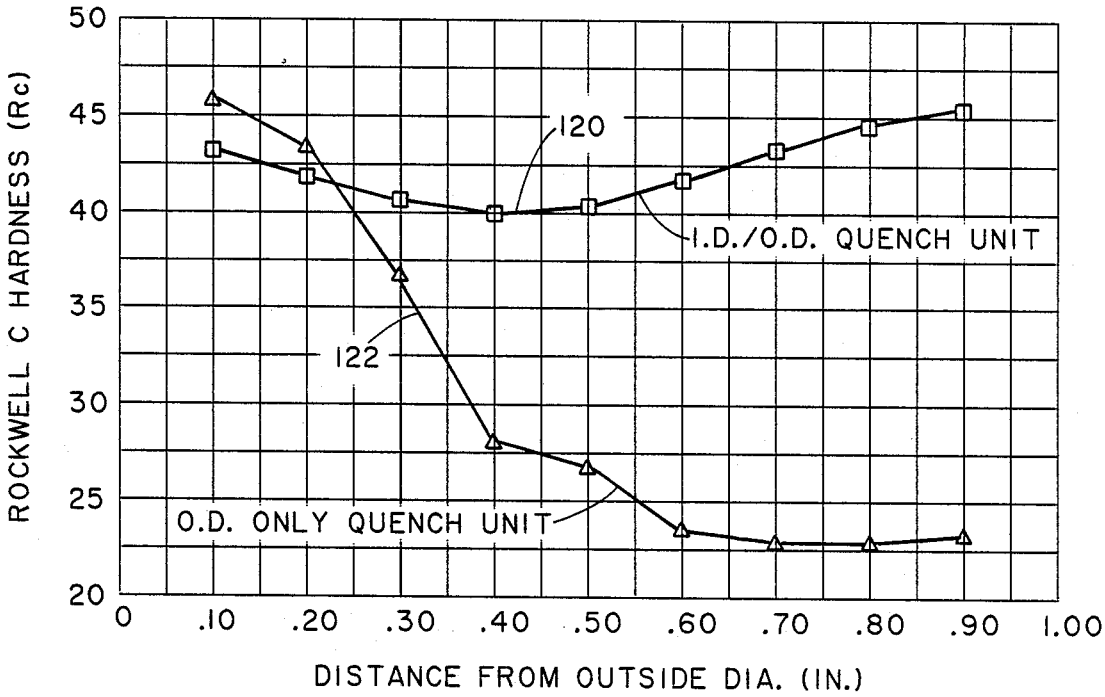
FIG. 8 is a graph of the hardness profile of the tubular member when quenched in accordance with the present invention compared to the prior art.
Figure 9:
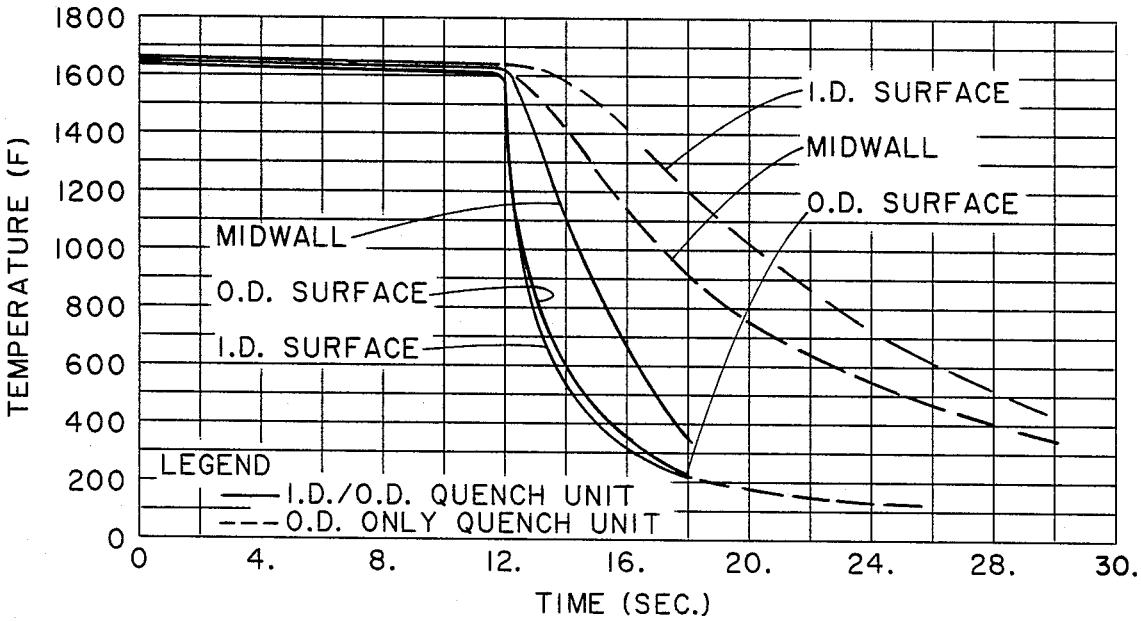
FIG. 9 is a graph illustrating the cooling rate of the tubular member when quenched in accordance with the present invention compared to the prior art; and, FIG. 10 is a graph illustrating the bow of the tubular member as a function of the rotational speed of the tubular member within the quench arrangement.

A comparison between tubular members quenched in the I.D./O.D. quench mechanism of the present invention when both tangential nozzles 22 and axial nozzle 32 are actuated is compared to the O.D. quench in the arrangement disclosed in U.S. Pat. No. 3,671,028 as shown in FIGS. 8 and 9. In FIG. 8, the Rockwell hardness obtained throughout the wall thickness of a tubular member having a one inch thick wall quenched on its outside surface 12 and its inside surface 13 is designated by line 120. The hardness profile obtained on the same tubular member quenched only on its outside surface 12 is illustrated by line 122. In the prior art quench, the hardness at the inside surface of tubular member 10 is approximately half that obtained on the outside surface whereas in the quench arrangement of the present invention the hardness throughout the cross-sectional area of the tubular member is maintained at approximately a ten percent total deviation. In FIG. 9, the cooling curve at the outside surface 12, inside surface 13 and the mid-wall of the tubular member for the present invention is shown by the curves drawn as solid lines while the same cooling curves for the same surfaces for the prior art O.D. only quench arrangement is shown as dotted lines. Both quench arrangements produce somewhat similar temperature cooling curves at the outside surface 12 of tubular member 10. There is however a significant difference between the cooling curves at the inside surface 13 and the mid-wall surface of the tubular member between the present invention and the prior art quench. It is to be noted that if the flow of coolant in axial nozzle 32 was shut off, the cooling of the present invention would produce the same curves shown in FIGS. 8 and 9 attributed to the prior art invention disclosed in the '028 patent.

Figure 10:
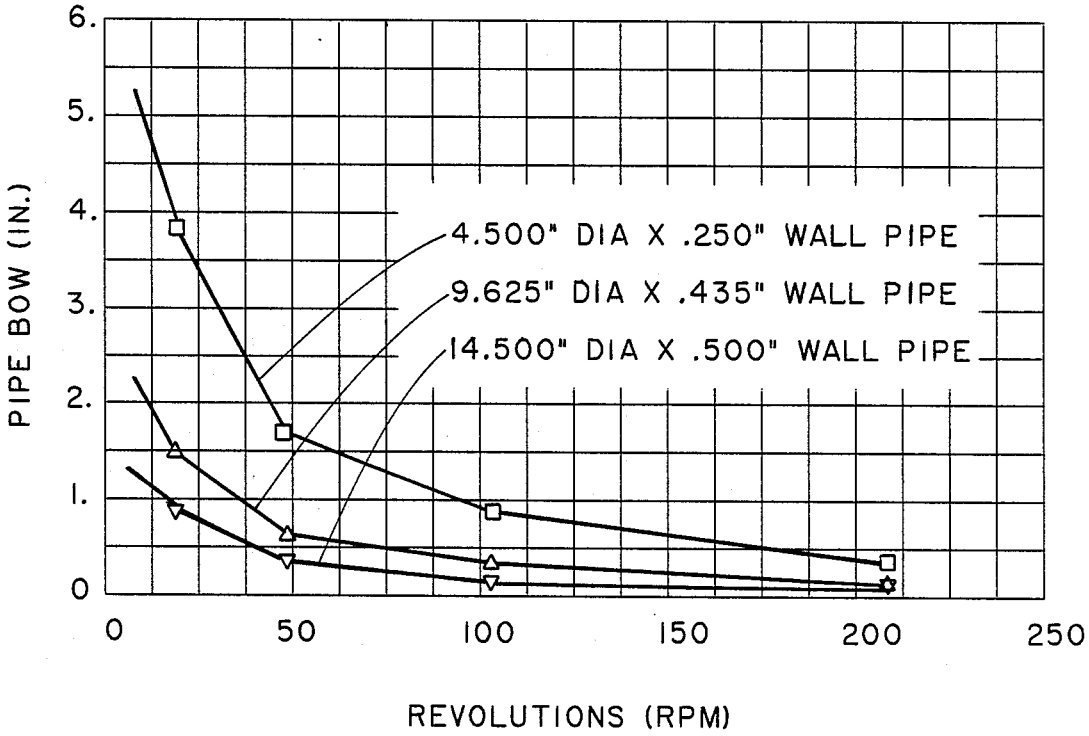

FIG. 10 illustrates the deflection or pipe bow which occurs in a 50 foot tubular member for the sizes noted as a function of the speed at which tubular member 10 is rotated about its longitudinal axis 14. As the rotational speed of the tubular member is increased, the deflection or bow in the pipe's length markedly decreases. Importantly, FIG. 10 illustrates that as the diameter of the tubular member increases, the pipe bow or deflection decreases and the rotational speed of the tubular member becomes less significant in controlling the distortion. It is also to be noted that since the inwardly directed jet sprays emanating from nozzles 22 preferably impinge tubular member 10 in a direction opposite to that of its rotation (to increase the heat transfer) the driving force exerted by the drive rollers 94 must be increased accordingly.

The invention has been described with reference to the preferred embodiment. Obviously, modifications and alterations will occur to others upon reading and understanding of the disclosure set forth herein. For example, while the invention has been disclosed with reference to a quench system which directs liquid coolant simultaneously against the inside and outside surfaces of the tubular member, should less stringent requirements be imposed, the quench system could operate either as a quench only for the outside surface or as a quench for the inside surface and still possess a considerable advantage over prior art mechanisms because of its fast quench time and its ability to quickly and efficiently process the work through the mill. It is our intention to include all such modifications and alterations insofar as they come within the scope of the present invention.

It is thus the essence of the present invention to provide an inside-outside quench arrangement and mechanism for tubular members which can simultaneously cool the inside and outside surface of the tubular member at approximately equal and very high heat transfer rates with minimal deformation, all in an arrangement which is very simple and efficient from a work processing point of view.

Having thus defined our invention, we claim:

1. Apparatus for quenching a tubular member having an elongated longitudinal axis, a laterally extending axis perpendicular to said longitudinal axis and a vertically extending axis perpendicular to said longitudinal axis and said lateral axis, said apparatus comprising:

(a) a plurality of O.D. quench supply means closely spaced at intervals along the length of said member and encircling said member about its longitudinal axis for cooling the outside surface of said member, each O.D. quench supply means including a plurality of jet spray nozzles spaced circumferentially about said member at a distance removed from the outside surface of said member with the axis of each jet spray nozzle oriented in a generally inward direction and perpendicular to said longitudinal axis so as to produce a swirling jet stream of a cooling liquid, said plurality of O.D. quench supply means providing a mass of coolant completely surrounding said outside surface of said member throughout its length;

(b) I.D. quench supply means directing a solid jet of liquid coolant into said tubular member for cooling the inside surface of said member, said I.D. quench supply means including an axial flow jet spray nozzle movably positioned at one end of said member to extend into said tubular member and having an axis generally in line with said longitudinal axis of said member;

(c) means controlling the flow of coolant between said I.D. and said O.D. quench supply means; and (d) drive roller means including drive rollers and idler rollers within said apparatus for supporting and rotating said member about its longitudinal axis in a stationary longitudinal position at a speed correlated to the diameter of said tubular member to minimize bowing of said member while also insuring approximately equal cooling rates between said I.D. and said O.D. quench supply means whereby said tubular member is evenly quenched from the inside and outside throughout its length from one end to the other end.

2. Apparatus as defined in claim 1, wherein said drive roller means further includes idler positioning means for adjusting said horizontal axis of said member so that said member's horizontal axis is generally centered with respect to said spray headers and in line with said axial flow jet spray nozzle so that said apparatus can quench different diameter tubular members.

3. The apparatus of claim 1 wherein said I.D. quench supply means includes said nozzle extending within one end of said tubular member and said O.D. quench supply means providing a stream of coolant between said nozzle and the inside diameter of said tubular member whereby said solid jet substantially fills the inside of said tubular member.

4. The apparatus of claim 3 wherein said rotation of said tubular member is opposite to the direction of said O.D. jet streams, and said means for controlling the flow of coolant to said I.D. and said O.D. quench supply means and said drive roller means is effective to quench said tubular member at a heat transfer rate which is limited only by the rate that heat can be conducted through the said tubular member.

5. The apparatus of claim 3 wherein said means for controlling the flow of coolant and said drive roller means quenches said tubular member at a rate determined by a heat transfer coefficient as high as 3000 btu's/hr/ft$^2$ ° F.

* * * * *